United States Patent [19]

Suess et al.

[11] 4,102,237

[45] Jul. 25, 1978

[54] STAND FOR AN ASSEMBLY OF MUSICAL DRUMS

[75] Inventors: Richard R. Suess, 7245 Fairbanks-N. Houston Rd., Houston, Tex. 77040; Frank A. Suess, San Antonio, Tex.

[73] Assignee: Richard R. Suess, Houston, Tex.

[21] Appl. No.: 773,903

[22] Filed: Mar. 3, 1977

[51] Int. Cl.[2] ..... G10D 13/02

[52] U.S. Cl. ..... 84/421

[58] Field of Search ..... 84/421; 224/5 S

[56] References Cited

U.S. PATENT DOCUMENTS

| | | | |
|---|---|---|---|
| 2,588,830 | 3/1952 | Haanstad | 84/421 |
| 3,774,823 | 11/1973 | Hoellerich | 84/421 X |
| 3,974,732 | 8/1976 | Kester | 84/421 |

FOREIGN PATENT DOCUMENTS

| | | | |
|---|---|---|---|
| 466,632 | 6/1937 | United Kingdom | 84/421 |

*Primary Examiner*—John Gonzales
*Attorney, Agent, or Firm*—Arnold, White & Durkee

[57] ABSTRACT

A stand is provided for supporting an assembly of musical drums which are interconnected and adapted to be carried by a marching bandsman. The stand includes a basin defining structure for receiving a carrier to which the drums are commonly secured. The carrier has a plurality of outwardly extending connectors for securing each of the drums, and the basin defining structure defines the basin by providing a base plate and associated structure having a plurality of basin slots corresponding to the connectors in number, size and location with respect to the base plate. The basin slots receive the connectors to allow the plurality of drums to be supported around an arc about the base plate. A base is coupled to and vertically supports the basin defining structure in a manner to allow unimpeded access to the drums. To this end and for providing stability, the base is designed to underlie the basin defining structure, yet not to extend beyond one side of the basin defining structure. In one embodiment for universally accomodating various carrier designs and configurations, the basin slots are formed by a plurality of outstanding members movably secured about the base plate.

10 Claims, 14 Drawing Figures

FIG. 1
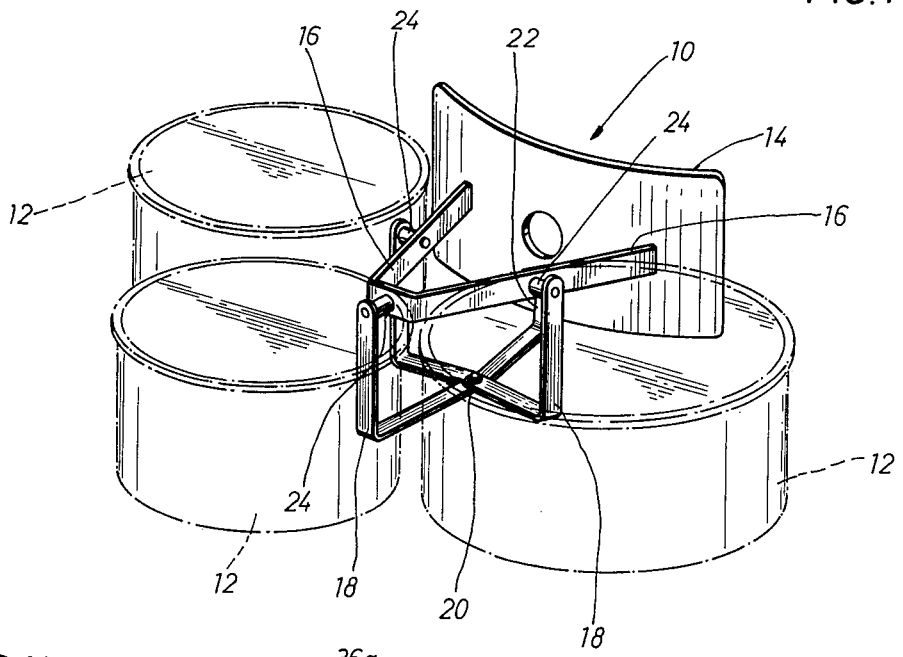
FIG. 11
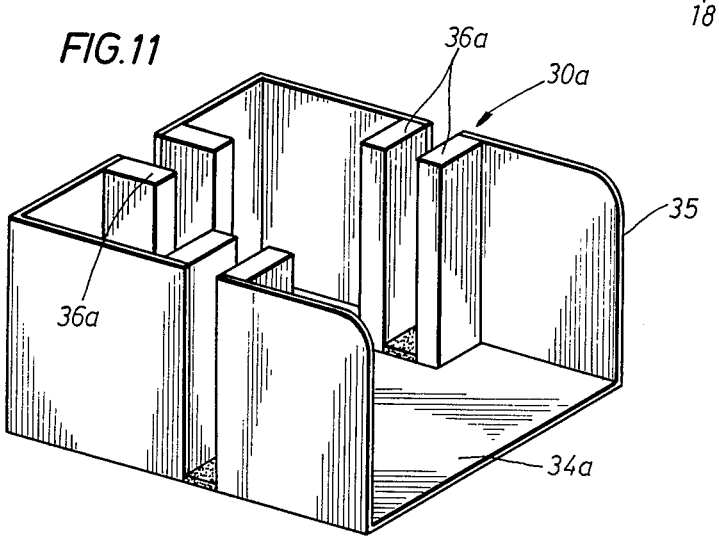
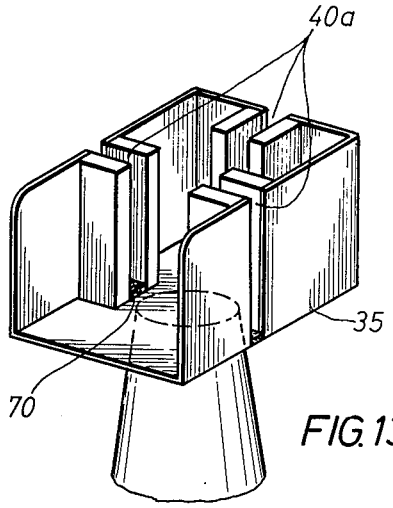
FIG. 13
FIG. 12
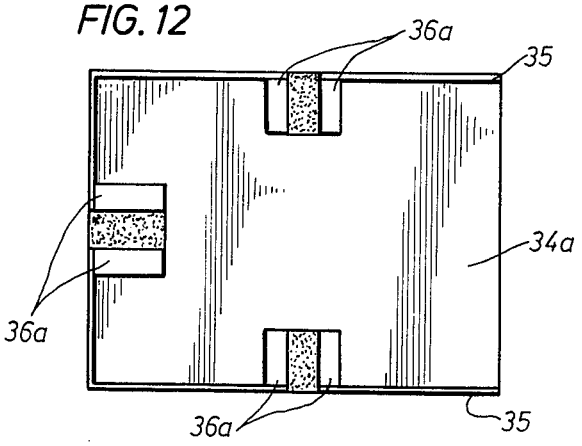
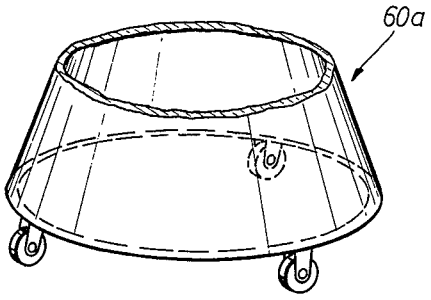

FIG.2b
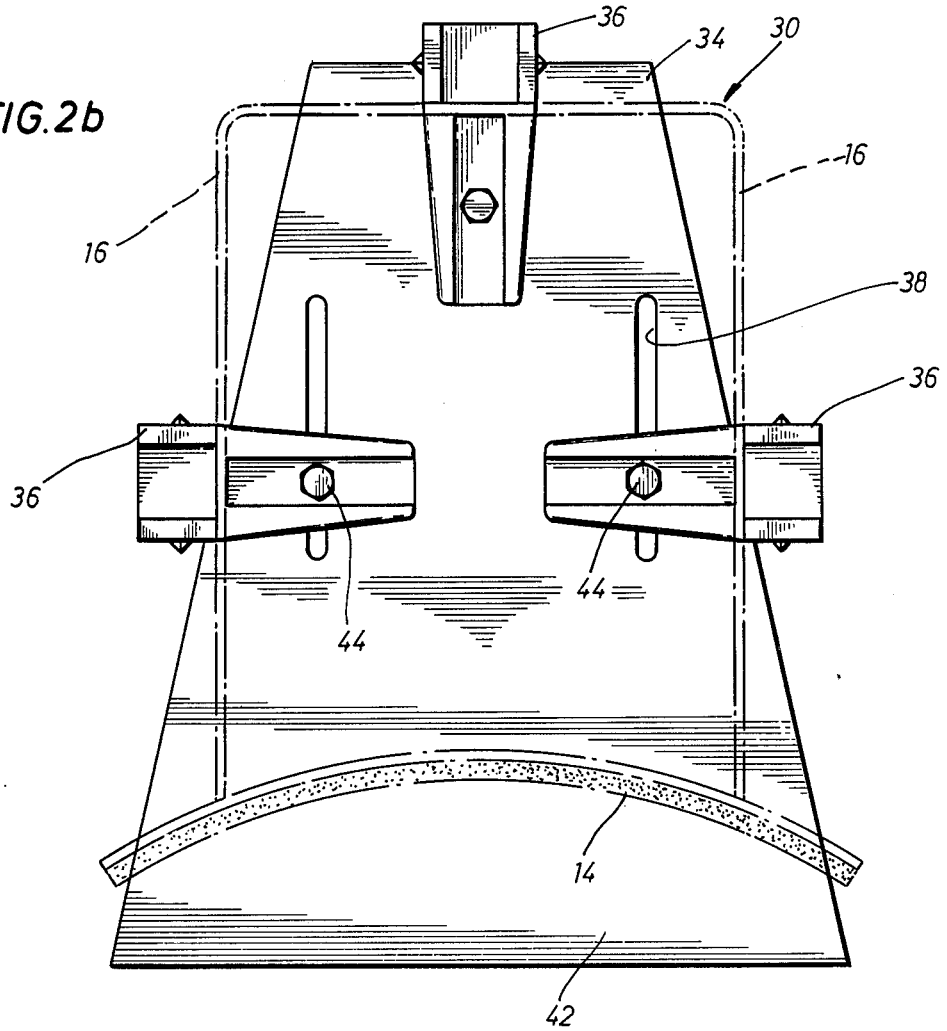
FIG.6
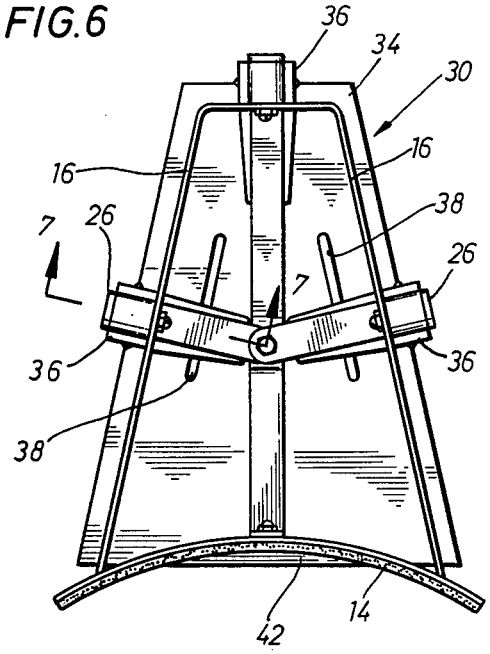
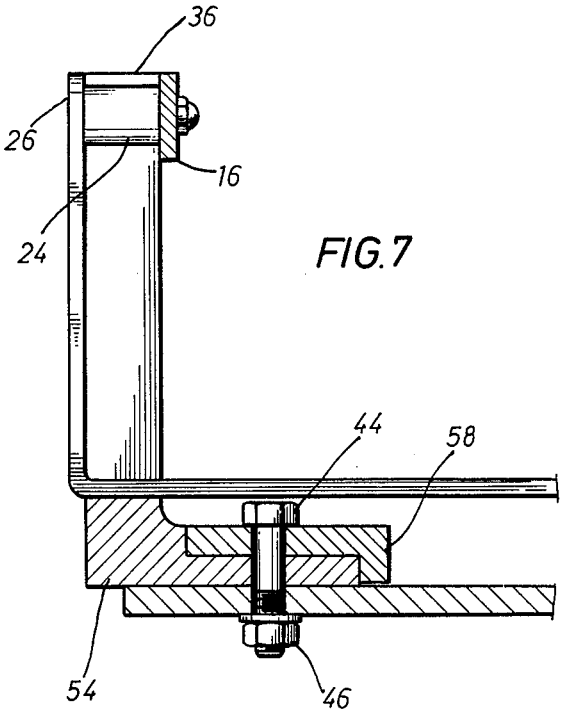
FIG.7

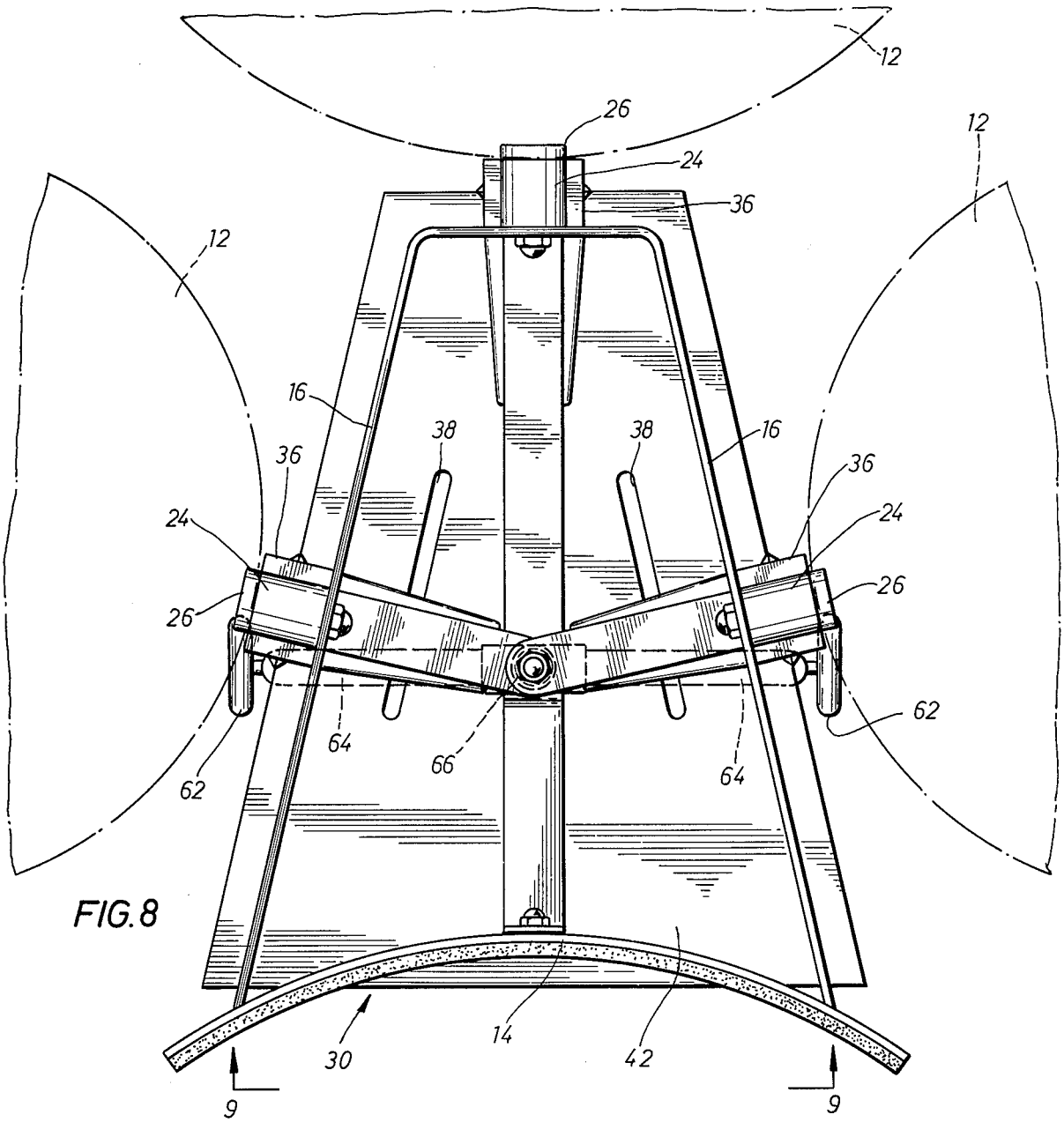
FIG. 8
FIG. 9
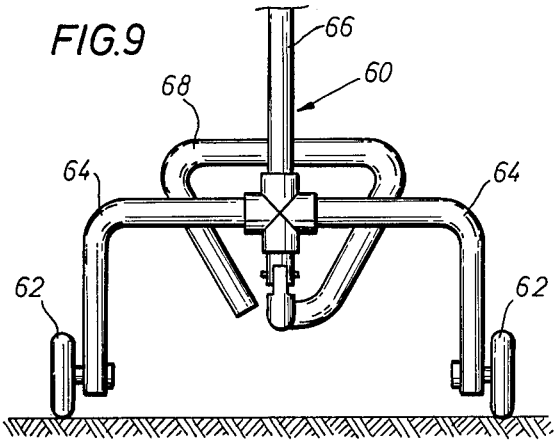
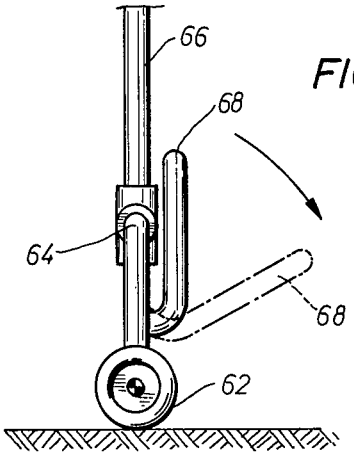
FIG. 10

STAND FOR AN ASSEMBLY OF MUSICAL DRUMS

BACKGROUND OF THE INVENTION

The present invention relates generally to stands for musical instruments, and relates more particularly to stands for multidrum arrangements having drums, such as Timp-Toms, secured to a common carrier which is adapted for carrying by a marching bandsman.

Timp-Toms are a form of percussion instrument, i.e., drums. There are usually three in number in a given assembly, but occasionally there may be as many as five, by adding two, twin small Congas, Timboles, or Bongos (drums). Timp-Toms are made and shaped like the standard drums except that they have no snare attachments and are left "open;" i.e., they have no bottom covers — as compared to standard drums which have both top and bottom covers or heads. Timp-Toms are usually constructed of a hard plastic material, or wood laminate shell, each varying from the others in diameter by as much as one to three inches, and are tuneable to produce differently pitched tones. Usually, they are from 14 to 28 inches in diameter and from 10 to 16 inches in depth.

For use as marching instruments, such as in parades, Timp-Toms are carried or mounted on a metallic multimount carrier. The carrier is usually either in a rectangular or A-shape approximately 18 to 20 inches in length and 6 inches wide. The carrier is configured to fit around the abdomen of the bandsman or percussionist and is fitted with a rubber or felted cushion about ½ inch thick to protect him from undue shock or vibration. The carrier is provided with metal loops at several suitable places to accept straps that fit across the bandman's shoulders and back to fasten it solidly to his body, about waist high. Welded or bolted to the carrier frame is a plurality (usually three or more depending on the number of Timp-Toms) of short arms, designed to accept the metal straps which are attached to, and form a part of, each Timp-Tom. The carrier thus supports the several Timp-Toms in a semi-circular position close to one another, in easy and convenient reach of the percussionist and about 12 to 18 inches from his body.

For convenience in description, the term drum will be utilized to generally describe all classes of musical, drum-type percussion instruments which are utilized with other such instruments for parade application.

Such multidrum arrangements having the common or multi-mount carrier are awkward to support when removed from the body of the bandsman. This is because the drums extend in cantilever fashion from the carrier in an unbalanced configuration, producing moment arms which effect a tendency of the arrangement to tip when supported solely by the carrier. This tendency to tip and general awkwardness has been a hindrance for temporarily storing the multidrum arrangement or using it in a band or orchestral setting. It has also necessitated disassembling and remounting the drums after parade use if they are then to be utilized in an orchestra.

SUMMARY OF THE INVENTION

The above noted and other drawbacks of the described multidrum, common carrier arrangement are overcome by providing a stand especially adapted for receiving the arrangement after parade use without disconnecting the several drums from the carrier and for supporting the arrangement with stability for either storage or for orchestra usage, thus extending the use of the multi-drum arrangement from a strictly marching use to total involvement in any band or orchestra. The stand is readily portable for easy and convenient placement in the orchestra when desired, and is constructed of a light weight, but brilliant material which is pleasing to the eye.

According to one embodiment of the invention, the stand is designed for supporting an assembly of musical drums, whereby the assembly is of the type adapted to be carried by a marching bandsman and which includes a plurality of drums and a carrier supporting the drums around a perimeter of the carrier. The carrier has a plurality of outwardly extending connectors for securing each of the drums. For receiving the carrier, the stand is comprised of basin defining structure including a unitary member having a base plate and side walls. The side walls define a plurality of basin slots corresponding in number, size, and location with respect to the base plate for receiving the plurality of connectors and thereby supporting the plurality of drums in a general arc about the unitary member. A base is coupled to and vertically supports the basin defining structure.

According to another aspect of the invention, the unitary member includes pairs of arms upstanding from the base, with the pairs of arms defining the base slots therebetween. The unitary member is comprised of die casted zinc to provide an overall light weight unit, yet which also provides an attractive by brilliant stand suitable for use in an orchestra.

According to another embodiment, the basin defining structure is not unitary but includes a base plate and a plurality of upstanding member assemblies which define a plurality of basin slots for receiving the respective connectors. The upstanding member assemblies are movably securable to the base plate and are positionable thereon for universally accommodating carriers of different sizes and configurations. Slots are provided in both the base plate and in legs of the upstanding member assemblies to allow wide freedom of movement of the assemblies.

Stability of and access to the arrangement when it is on the stand is achieved by a base which is specially designed with respect to the basin defining structure. The basin slots all lie to one side of an imaginary vertical plane cutting the basin defining structure, whereby the drums are supported by the stand in a generally arcuate segment about the base plate, and the bandsman may stand immediately adjacent the structure on the other side of the plane. The base is designed to extend underlying the portion of the basin defining structure on the one side of the plane and substantially does not extend beyond the other side of the plane. This provides a stable support, yet allows access to the drums by the bandsman.

It is accordingly a general object of the present invention to provide a new and improved stand for a multimount carrier which supports a plurality of drums about the body of a marching bandsman, whereby the stand will accommodate and stably support the carrier and drums as an assembly when unstrapped from the bandsman without the need of making any changes to the carrier or of disconnecting the drums from the carrier, i.e., by simply placing the arrangement on the stand as is.

The above noted and other objects and advantages will be more apparent from the following description of a detailed embodiment of the invention, when read in conjunction with the drawings.

BRIEF DESCRIPTION OF THE DRAWINGS

FIG. 1 is a schematic view of a multidrum, multimount arrangement of the marching type employed in conjunction with the invention.

FIGS. *2a, 2b* are plan views of basin defining structures in combination with carriers of the general type depicted in FIG. 1.

Figure 2A:
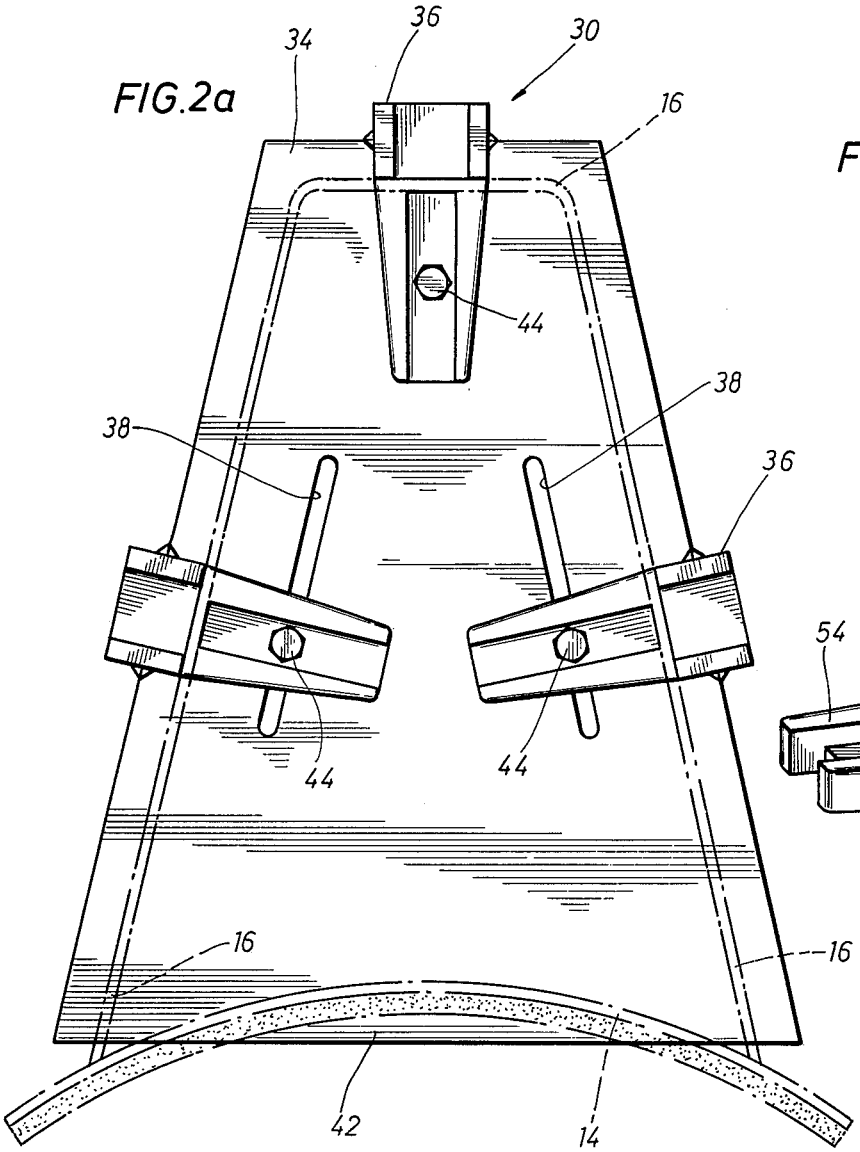
Figure 3:
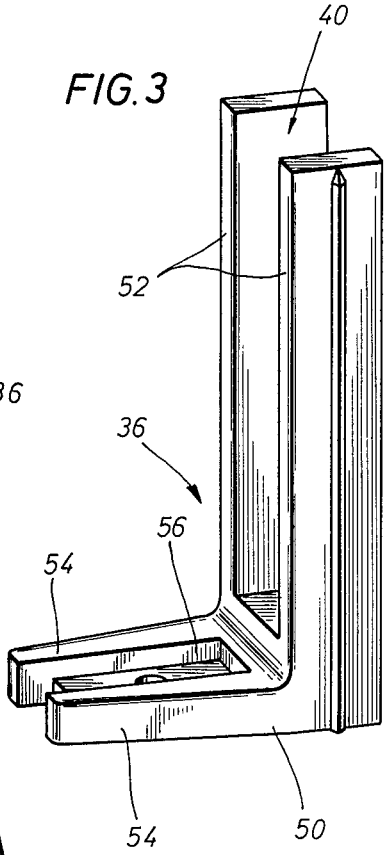
Figure 5:
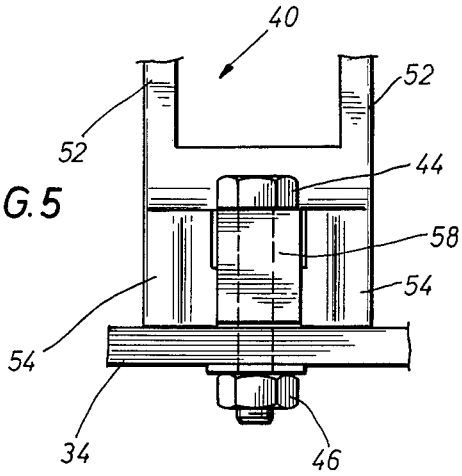
Figure 4:
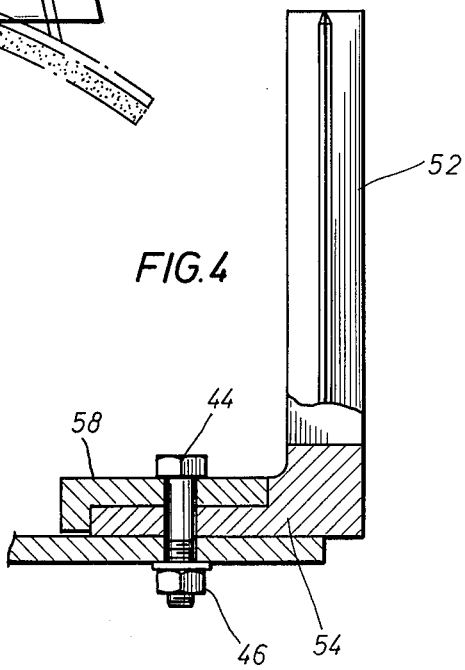

FIGS. 3–5 are views of upstanding member assemblies utilized in defining basin slots in the embodiments of FIG. 2.

FIG. 6 is a view of a carrier as supported by the basin defining structure of FIG. 2.

FIG. 7 is a cross sectional view through an upstanding member assembly of FIG. 6.

FIG. 8 is a top plan view of the arrangement of FIG. 1 supported by the embodiment of FIG. 2.

FIGS. 9–10 are views of a stand for supporting the basin defining structure.

FIGS. 11–13 are schematic views of another embodiment of the basin defining structure.

DESCRIPTION OF PREFERRED EMBODIMENTS

Referring now to FIG. 1 a multi-mount carrier 10 for a plurality of drums 12 is depicted and is of the type contemplated by the invention. The term "drum" refers to all percussion, musical instruments, such as but not limited to timp-toms, congas, timboles, bongas, and conventional drums which are adapted to be commonly assembled and carried for parade applications. The carrier 10 is of the type for supporting a plurality of the drums 12 by virtue of being strapped to the body of a bandsman during marching.

The carrier 10 has a body plate 14 which is positioned against the abdomen of the bandsman, and a frame 16. The frame 16 is generally in a rectangular or A-shape and is secured to the body plate 14. Mounted to the frame 16 is a plurality of L-shaped side arms 18, each of which having one end thereof coupled to the frame 16 and the other end thereof commonly connected to one another at a junction 20. A strap 22 connects the junction 20 to the body plate 14. Between the coupling of the side arm 18 with the frame 16, a spool 24 is utilized for maintaining the side arms 18 a spaced distance from the frame 16 to allow mounts (not shown) on the drums 12 to be attached to the side arms 18.

Referring now to FIGS. *2a, 2b,* 6 and 7, the carrier 10 is shown in association with a head 30 according to one embodiment of the invention. In FIGS. *2a* and *2b,* two such carriers 10 are depicted in association with the head 30.

The head 30 includes a base plate 34 and a plurality of arm assemblies 36 which are movably secured to the base plate 34. The base plate 34 defines a plurality of base plate slots 38, and the assemblies 36 define a plurality of basin slots 40. The basin slots 40 receive the side arms 18 for supporting the carrier 10 and the drum arrangement. The slots 38 allow positioning of the slots 40 for accommodating carriers 10 having frames 16 of different sizes and geometric configurations. For example and as illustrated, the slots 38 are generally parallel to one long side of the frame 16 and, for the rectangular frame 16 embodiment of FIG. *2b,* are perpendicular to a side 42 of the base plate 34. The slots 38 are positioned on the base plate 34 so that the basin slots 40 all lie to one side of an imaginary vertical plane which cuts the base plate such that the drum arrangement is supported about the plane, and a bandsman may stand immediately adjacent the side 42 for complete access to all drums. It is understood that a pair of the slots 38 for each of the arm assemblies 36 may be provided, with one slot parallel to the side of the base plate 34 and the other slot 38 skewed with respect to the base plate 34, thereby one of the slots 38 being parallel to either a rectangular or an A-shaped frame 16 placed within the head 30.

The arm assemblies 36 are secured to the base plate 34 by way of bolts 44 extending through the slots 38 for allowing selective positioning of the basin slots 40. Nuts 46 secure the arm assemblies 36 when the arm assemblies 36 have been positioned on the base plate 34 at proper orientations and locations to receive the side arms 18 of a particular carrier 10. Thus, as seen in phantom in FIGS. *2a, 2b* a given arm assembly 36 may be rotated about the bolt 44 while the bolt 44 is slid along a given one of the slots 38 until the proper orientation and location is achieved.

Referring now to FIGS. 3–7, the arm assemblies 36 are shown in more detail. Each arm assembly includes a base portion 50 which supports a pair of upstanding arms 52. A pair of the upstanding arms 52 define one of the basin slots 40 therebetween for receiving the side arms 18 of the frame 16. The base portion 50 includes a pair of legs 54 which are spaced to define a channel 56. The bolt 44 is positioned within the channel 56 to allow the arm assemblies 36 to be translated along the channel 56. This provides an additional degree of freedom for adjusting the arm assemblies 36 for accommodating carriers 10 of different geometric sizes.

An L-shaped locking bar 58 fits into the channel 56 and has a hole for receiving the bolt 44. The locking bar 58 overlies a recessed center surface between the legs 54 such that, when drawn securely towards the base plate 34 via the bolt 44, the legs 54 and thus the arm assemblies 36 are securely locked into engagement with the base plate 34 in the desired position.

In the preferred embodiment either the arm assemblies 36 and the base plate 34 are made of metallic zinc or their surfaces are zinc coated. This allows not only a light weight head 30 to be provided, but it provides a visually attractive, brilliant appearance to be achieved, suitable for use in association with musical instruments. It is understood, however, that durable metals, such as steel and aluminum, and hard plastic or fiberglass may also be suitable.

Referring now to FIGS. 8–10, a stand 60 is shown in combination with the head 30. The stand 60 supports the head 30 approximately waist high to the average bandsman, and is especially designed to support the described drum arrangement and to obviate the tendency thereof to tip. That is, because the drum arrangement tends to provide moment arms about the frame 16, and the moment arms are nonuniformally spaced, the arrangement has a tendency to tip away from the edge 42.

The stand 60 has a set of wheels 62 which are supported on a pair of legs 64. The legs 64 are secured to an L-shaped tubular arrangement 66. The L shaped tubular arrangement 66 has a triangular base 68 which is bent away from the wheels 62 towards an area underlying the head 30. The triangular base 68 extends sufficiently beneath the head 30 that it underlies the center of mass of the drum arrangement, thereby supporting it.

Referring now to FIGS. 11–13 an embodiment (hereinafter referred to as the "dedicated" embodiment) which is designed for accommodating a carrier 10 of a specific size and geometric configuration is shown. The dedicated embodiment is generally similar to the embodiment described in FIGS. 2 (i.e. the "universal" embodiment) except the basin grooves 40 are not defined by movable assemblies. Structure in the dedicated embodiment analagous to structure in the universal embodiment bears like numerals having a subscript "*a*" designation.

The head 30*a* includes a base plate 34*a* and a set of side walls 35. The side walls 35 and the base plate 34*a* support a plurality of arm assemblies 36*a*. The arm assemblies 36*a* are immovably disposed with respect to the walls 35 and base plate 34*a* and are positioned and of a size to accommodate a particular design of a carrier 10.

The arm assemblies 36*a* define basin grooves 40*a* for receiving the side arms 18 of the carrier 10. The arm assemblies 36*a* may be an integral part of the side walls 35. Further, if the side walls 35 are of a sufficiently heavy strength, the side walls 35 may themselves define the assemblies 36*a;* i.e., the slots 40 may be defined by the side walls 50.

According to the dedicated embodiment, the head 30*a* is integrally formed of die casted zinc and the base 60*a* is zinc plated. Although the head 30*a* and the arm assemblies 64*a* can be formed of steel, aluminum or other durable metal, or of a hard plastic or fiberglass, zinc is preferred because of its light weight and ability to provide the brilliant surface required for acceptance in the music industry. Furthermore, the dedicated embodiment is particularly adapted for inexpensive manufacture because its design is readily adapted for single mold manufacturing processes.

Although rather detailed embodiments of the invention have been described, it is understood that such descriptions have been by way of example. Numerous changes and modifications will become apparent to those of ordinary skill in the art without departing from the spirit and new scope of the invention as hereinafter claimed.

What is claimed is:

1. A stand for supporting an assembly of musical drums, said assembly adapted to be carried by a marching bandsman and including a plurality of percussive drums and a carrier commonly supporting the drums around a perimeter thereof, the carrier having a plurality of connectors extending outwardly for securing each of the drums, the stand comprising:

a basin defining structure for receiving said carrier, said basin defining structure including a base plate and a plurality of upstanding members which define a plurality of basin slots for receiving respective ones of said connectors, said upstanding members being movably securable to the base plate for accommodating carriers of different sizes and configurating; and a base coupled to and vertically supporting the basin defining structure.

2. The stand according to claim 1 wherein said base plate defines a plurality of base plate slots for allowing positional adjustment of said upstanding members on the base plate.

3. The stand according to claim 2 wherein said base plate is configured in an A-shape.

4. The stand according to claim 3 wherein said basin defining structure comprises die casted zinc.

5. The stand according to claim 1 wherein said basin slots all lie to one side of a line across said basin defining structure, whereby said drums are supported by the stand in a generally arcuate segment about the basin defining structure, and the bandsman may stand immediately adjacent said basin defining structure on the other side of said line.

6. The stand according to claim 5 wherein said base is designed to extend underlying the portion of said basin defining structure on the one side of said line and substantially does not extend beyond the other side of said line, thereby providing a stable support yet allowing access to the drums by the bandsman.

7. The stand according to claim 2 wherein said upstanding members each includes a slotted base portion for being secured to said base plate, and a pair of arms extending transversely of said base portion and defining said basin slots therebetween.

8. A stand for supporting an assembly of musical drums, said assembly adapted to be carried by a marching bandsman and including a plurality of percussive drums and a carrier commonly supporting the drums around a perimeter thereof, the carrier having a plurality of connectors extending outwardly for securing each of the drums, the stand comprising:

a basin defining structure for receiving the carrier, said basin defining structure including a unitary member which defines the basin by providing a base plate and side walls, the side walls defining a plurality of basin slots corresponding in number, size, and location with respect to the base plate for receiving said plurality of connectors to thereby allow the plurality of drums to be supported around an arc about said unitary member; and a base coupled to and vertically supporting the basin defining structure.

9. The stand according to claim 8 wherein said unitary member is comprised of die casted zinc.

10. The stand according to claim 8 wherein said unitary member includes pairs of arms upstanding from said base and defining said base slots therebetween.

* * * * *